US005127844A

United States Patent [19]

Léman et al.

[11] Patent Number: 5,127,844

[45] Date of Patent: Jul. 7, 1992

[54] CONNECTION BLOCK FOR PLUG-IN ADAPTER

[75] Inventors: Ari Léman, Pertteli; Pekka Hakanen, Turku, both of Finland

[73] Assignee: Nokia Mobile Phones Ltd., Salo, Finland

[21] Appl. No.: 674,522

[22] Filed: Mar. 22, 1991

[30] Foreign Application Priority Data

Apr. 12, 1991 [FI] Finland ..... 901891

[51] Int. Cl.[5] ..... H01R 13/627

[52] U.S. Cl. ..... 439/353; 439/374

[58] Field of Search ..... 439/300, 353, 354, 357, 439/344, 374, 378, 555, 557, 680

[56] References Cited

U.S. PATENT DOCUMENTS

| | | | |
|---|---|---|---|
| 3,430,188 | 2/1969 | Leach | 439/555 |
| 3,569,909 | 12/1968 | Garver | 439/353 |
| 4,241,974 | 12/1980 | Hardesty | 439/352 X |
| 4,460,234 | 7/1984 | Bogese | 439/557 |
| 4,504,108 | 3/1985 | Fiumefreddo et al. | 439/557 |
| 4,508,410 | 4/1985 | Canham . | |
| 4,664,456 | 5/1987 | Blair et al. | 439/378 X |
| 4,717,358 | 1/1988 | Chaundy | 439/557 |
| 4,795,375 | 1/1989 | Williams | 438/680 |

FOREIGN PATENT DOCUMENTS

| | | |
|---|---|---|
| 3000286 | 7/1981 | Fed. Rep. of Germany . |
| 2204195 | 11/1988 | United Kingdom . |

*Primary Examiner*—Larry I. Schwartz
*Assistant Examiner*—Khiem Nguyen
*Attorney, Agent, or Firm*—Darby & Darby

[57] ABSTRACT

The invention relates to a connection block for a plug-in adapter, suitable for being mounted on a mobile telephone or its cradle. The block is further connected to, e.g., a cigarette lighter outlet of a vehicle that can supply current to the connection block. The block is further provided with latch claws (2) capable of locking the connector block to the mobile telephone or its cradle. The latch claws (2) are integral with the housing of the connection block and resilient in such a manner that allows the latch claws to be movable between an open position and a closed position by applying pressure with the fingers on actuation areas (3) on the latch claws.

5 Claims, 2 Drawing Sheets

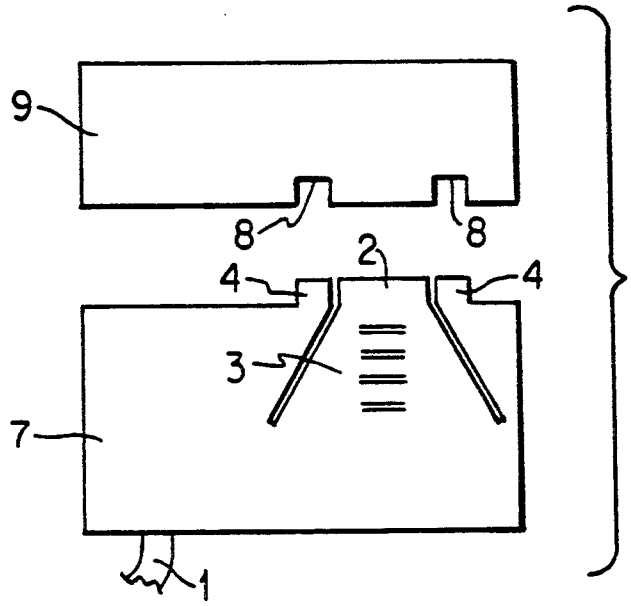
FIG. 2
FIG. 3
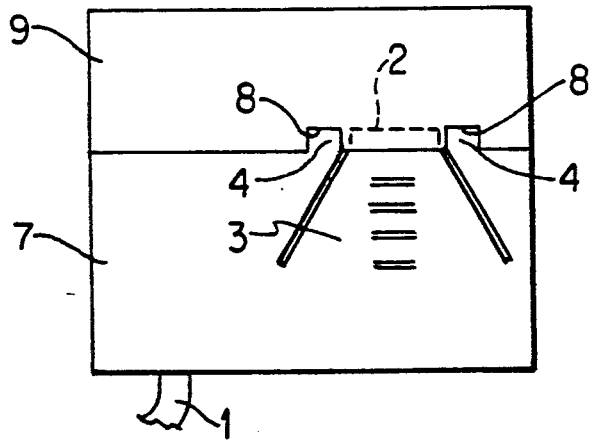

CONNECTION BLOCK FOR PLUG-IN ADAPTER

BACKGROUND OF THE INVENTION

1. Field of the Invention

The present invention relates to a connection block for a plug-in adapter, suitable for being mounted on, e.g., a mobile telephone or its cradle, said block being further connected to, e.g., a cigarette lighter outlet of a vehicle that can supply current to the connection block, said block further being provided with latch claws capable of locking the connector block to the mobile telephone or its cradle.

2. Discussion of Related Art

In prior art the connection blocks have been implemented with the use of different lever or similar mechanisms which may also have included discrete springs. The many discrete members contribute to higher price, make assembly complicated, take up a large volume; and moreover, they also often even make the device more difficult to use. It is an object of the present invention to overcome the above described disadvantages. A connection block for a plug-in adapter according to the invention is characterized in that the latch claws are integral with the housing of the connection block and resilient in such a manner that allows the latch claws to be movable between an open position and a closed position by applying pressure with the fingers on actuation areas designed on the latch claws. The invention makes it possible to achieve a low-priced connection block which is both easily assembled and small in size. This is related to the integral design of the guiding and latching means with the housing structure. Consequently, the actuation areas of the latch claws do not consume inner volume of the connection block.

SUMMARY OF THE INVENTION

An embodiment of the invention is characterized in that the sides of the latch claw include guide pins which also are integral with the housing of the connection block and that the mobile telephone or its cradle include recesses which are compatible with the guide pins. Thus, the location of the guide pins provide protection for the latch claw when the connection block is not inserted. By virtue of the guide pins, the latch claws are subjected to tensile stress only, when the connection block is in the inserted position.

Another embodiment of the invention is characterized in that the sides of the connector in the connection block are provided with curved protective walls. The protective walls provide protection to the connector when the connection block is not in an inserted position. Further, the connection block consumes only a minimal volume in the equipment in which the block is mounted.

BRIEF DESCRIPTION OF THE DRAWINGS

In the following description the invention is described by way of an exemplifying embodiment with reference to the attached drawings which show a connection block for a plug-in adapter, said block being suitable for mounting to the lower portion of a mobile telephone, wherein:

FIG. 2 is a front elevational schematic representation of the connection block of FIG. 1 and a plug-in adapter prior to their engagement.

FIG. 3 is a front elevational schematic representation of the connection block and plug-in adapter of FIG. 2 after engagement.

DESCRIPTION OF THE PREFERRED EMBODIMENT

Figure 1:
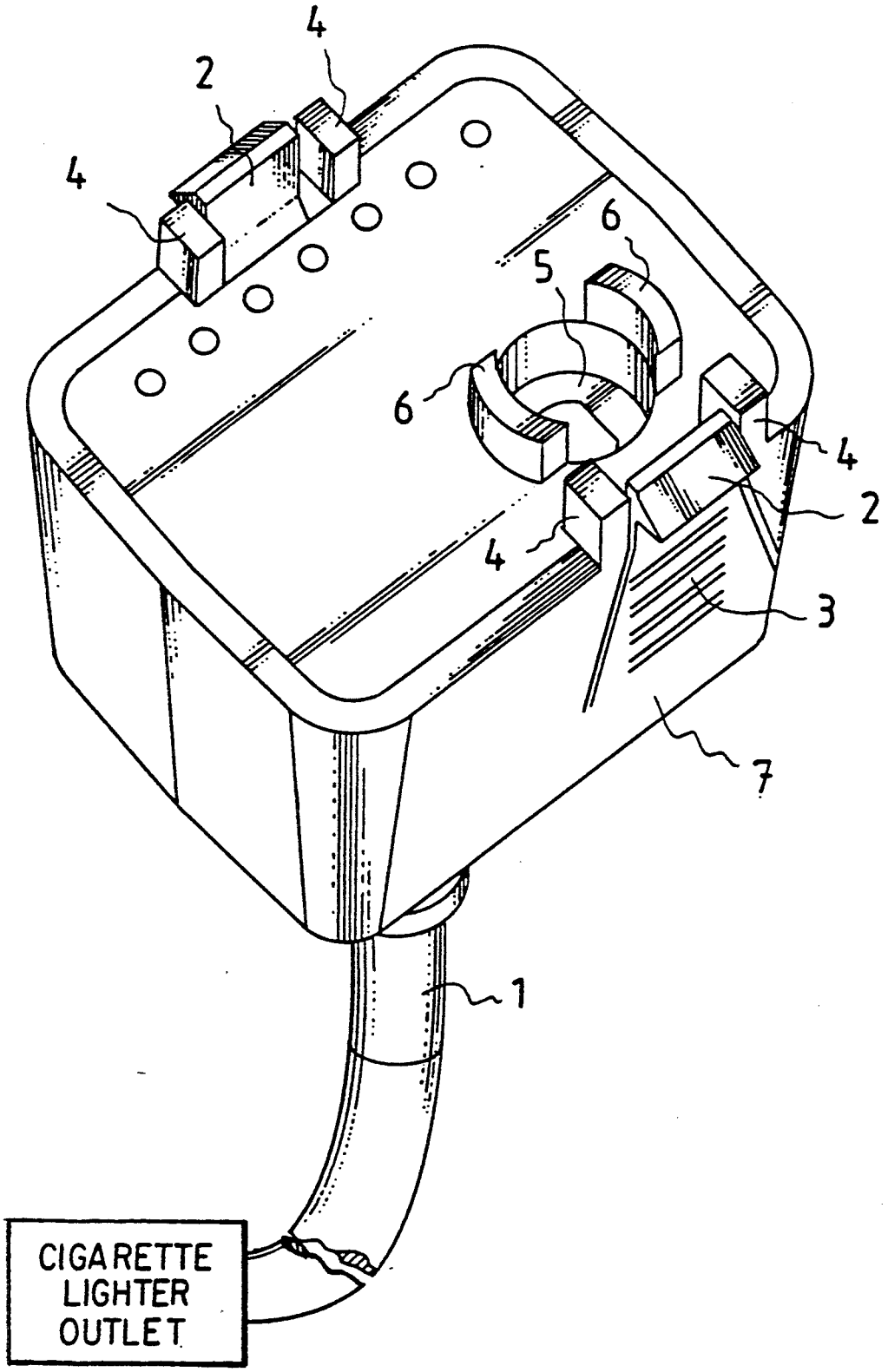
FIG. 1 is a perspective view of the connection block in accordance with the invention.

The connection block for a plug-in adapter 9 is attached via a cable 1 to the cigarette lighter outlet of a vehicle that can supply current to the connection block. The connection block has latch claws 2 with which the connection block can be locked to the mobile telephone. The latch claws 2 are integral with the housing of the connection block and resilient in such a manner that allows the latch claws to be movable between an open position and a closed position by applying pressure with the fingers on actuation areas 3 on the latch claws. The sides of the latch claw 2 are provided with guide pins 4 which also are integral with the housing of the connection block. The plug-in adapter of the mobile telephone is provided with recesses 8 which are compatible with the guide pins 4 (FIGS. 2 and 5). The sides of a connector 5 in the connection block are surrounded by curved protective walls 6. When engaging the connection block, the guide pins 4 serve as a guide for positioning the connection block in place. During insertion, the latch claws 2 spring inwardly from outer walls 7 of the block and perform the latching operation inherently. The disengagement takes place by pressing the actuation areas 3 designed on the outer walls of the block, combined with a simultaneous pulling action on the plug-in adapter 9. The connection block can be fabricated by injection molding which yields a pleasant look without further postprocessing. Alternatively, the construction can be fabricated by bending from thin sheet metal, whereby the connection block achieves the properties of an RFI shield. The production costs are, of course, lower with injection molding techniques.

We claim:

1. A connection block for a plug-in adapter, comprising:

a body having a side surface and a top surface;

means extending from the body for effecting connection with an outlet of a vehicle through which current may be supplied to the connection block;

means for releasably locking the connection block to the plug-in adapter, the locking means including latch claws integral with the body, each of the latch claws having as associated actuation portion generally aligned with the side surface and an associated protruding portion at an end of the actuating portion, the projecting portion extending above the top surface and projecting laterally away from the associated actuation portion, the latch claws each being resilient under manual pressure applied to the associated actuation portion to cause the associated protruding portion to be movable from a closed position when no manual pressure is applied to an open position when manual pressure is applied; and at least two guide pins integral with the body and extending upward from and above the top surface on either side of the projecting portion to protect the projecting portion from damage.

2. A connection block as in claim 1, wherein the top surface has a recess, further comprising:

a connector in the connection block and accessible via the recess; and protecting walls extending from the top surface at locations adjacent to the recess.

3. A connection block as in claim 1, wherein the side surface includes two opposite sides, each of the actuating portions extending in general alignment with a respective one of the opposite sides.

4. A connection block for a plug-in adapter, comprising:

a body having a side surface and a top surface;

means extending from the body for effecting connection with a cigarette lighter outlet of a vehicle through which current may be supplied to the connection block;

locking means for releasably locking the connection block to a plug-in adapter of one of a mobile telephone and its cradle, the releasably locking means being integral with the body and being releasable from engagement manually, a protruding portion of the locking means extending above the top surface of the body; and a plurality of guide pins integral with the body and extending upward from and above the top surface of the body, the protruding portion of the releasably locking means being between a respective two of the guide pins so as to be protected thereby.

5. A connection block as in claim 4, wherein the body has a recess, further comprising:

a connector in the connection block and accessible via the recess; and at least one protective wall extending above the top surface of a location adjacent to the recess.

* * * * *